US006435695B1

(12) United States Patent
Altman

(10) Patent No.: US 6,435,695 B1
(45) Date of Patent: Aug. 20, 2002

(54) PERIPHERALLY SEALED CARD-LIKE FLASHLIGHT DEVICE HAVING LIGHT GENERATING MODULE AND HOLDER THEREFOR SEATED IN CAVITY OF MAIN BODY STRUCTURE

(75) Inventor: Peter Altman, Austin, TX (US)

(73) Assignee: Lumatec Industries, Inc., Austin, TX (US)

( * ) Notice: Subject to any disclaimer, the term of this patent is extended or adjusted under 35 U.S.C. 154(b) by 0 days.

(21) Appl. No.: 09/767,252

(22) Filed: Jan. 22, 2001

(51) Int. Cl.[7] ..... F21L 4/00

(52) U.S. Cl. ..... 362/189; 362/201; 362/208; 362/200

(58) Field of Search ..... 362/200, 201, 362/189, 208, 186, 253

(56) References Cited

U.S. PATENT DOCUMENTS

| | | | | |
|---|---|---|---|---|
| 3,310,668 A | | 3/1967 | Schwartz | 362/116 |
| 4,085,315 A | | 4/1978 | Wolter et al. | 362/116 |
| 4,521,833 A | | 6/1985 | Wolter | 362/116 |
| 4,644,451 A | | 2/1987 | Chabria | 362/189 |
| 5,158,356 A | | 10/1992 | Guthrie | 362/188 |
| 5,457,613 A | | 10/1995 | Vandenbelt et al. | 362/200 |
| 5,893,631 A | | 4/1999 | Padden | 362/201 |
| 5,927,846 A | | 7/1999 | Sinclair | 362/189 |
| 5,934,789 A | | 8/1999 | Sinclair et al. | 362/189 |
| 6,039,454 A | * | 3/2000 | Hallgrimsson | 362/116 |
| 6,070,990 A | * | 6/2000 | Dalton et al. | 362/201 |
| 6,109,762 A | | 8/2000 | Hallgrimsson et al. | 362/200 |
| 6,270,234 B1 | * | 8/2001 | Au-Yeung | 362/189 |
| 6,299,323 B1 | * | 10/2001 | Yu et al. | 362/116 |

FOREIGN PATENT DOCUMENTS

| | | |
|---|---|---|
| FR | 1443787 | 5/1966 |

* cited by examiner

*Primary Examiner*—Sandra O'Shea
*Assistant Examiner*—Ronald E. Delgizzi

(57) ABSTRACT

A flashlight device includes a body structure, light generating module, holder, card and outer cover. The body structure has a cavity between upper and lower sides thereof, open at least at the upper side, and closer to a front end than to a rear end thereof. The body structure also has a channel between the upper and lower sides, extending between the cavity and front end, and open to the cavity, upper side and front end. The holder has an annular portion and spaced apart leg portions connected thereto and extending therefrom such that the annular and leg portions insert and fit within the cavity and channel of the body structure and seat therein the light actuating and generating components of the module. The card covers the upper side of the body structure and the module and holder. The cover encases the body structure, module, holder and card.

30 Claims, 4 Drawing Sheets

PERIPHERALLY SEALED CARD-LIKE FLASHLIGHT DEVICE HAVING LIGHT GENERATING MODULE AND HOLDER THEREFOR SEATED IN CAVITY OF MAIN BODY STRUCTURE

BACKGROUND OF THE INVENTION

1. Field of the Invention

The present invention generally relates to portable lighting devices and, more particularly, is concerned with a peripherally sealed card-like flashlight device having a light generating module and a holder therefor seated in a cavity of a main body structure of the flashlight device.

2. Description of the Prior Art

Portable miniature flashlight devices which can be stored in a pocket or attached to a key chain are known in the prior art. Examples of such portable flashlight devices are disclosed in U.S. Pat. No. 3,310,668 to Schwartz, U.S. Pat. No. 4,085,315 to Wolter et al., U.S. Pat. No. 4,521,833 to Wolter, U.S. Pat. No. 4,644,451 to Chabria, U.S. Pat. No. 5,158,356 to Guthrie, U.S. Pat. No. 5,893,631 to Padden, U.S. Pat. No. 6,109,762 to Hallgrimsson et al. and French Pat. No. 1,443,787 to Teisseire.

Some common components of portable miniature flashlight devices include a housing, a battery disposed in the housing, an electric lamp supported in the housing, electrically conductive contact members positioned in the housing and electrically interconnecting spaced contact portions of the lamp with spaced contact portions of the battery of respective positive and negative polarities, and an actuating element mounted on the housing and being movable for closing and opening an electrical circuit between the electrically conductive contact members, the battery and the lamp.

The housings of these devices have various configurations and constructions. However, a common theme of the housings as well as other components is that they are mostly utilitarian in character. Miniature flashlight devices are increasingly popular with consumers thereof because of their utilitarian character. The inventors herein have perceived of innovative ways to expand both aesthetic and utilitarian attributes of portable miniature flashlight devices without sacrificing the previous utilitarian character of such devices.

SUMMARY OF THE INVENTION

The present invention provides a peripherally sealed card-like flashlight device designed to satisfy the aforementioned needs. The device is provided with a main body structure which can be made of different materials and can support cards with different indicia thereon, such as logos or other business information. The device also is provided with a holder, a light generating module seated on the holder, and an outer protective transparent enclosure. The holder and light generating module are inserted in a cavity and channel of the body structure and the outer protective cover encases the body structure, light generating module, holder and card therein. The body structure, card and outer cover together can provide the device with different exterior shapes. Given such construction, the device of the present invention employs both aesthetic and utilitarian attributes which will be highly attractive to consumers, such as businesses and the like.

Accordingly, the present invention is directed to a card-like flashlight device which comprises: (a) a main body structure having upper and lower sides, front and rear ends, a cavity defined between the upper and lower sides and located closer to the front end than to the rear end, and a channel defined between the upper and lower sides and extending between and interconnecting the cavity and front end, the cavity being open at least at the upper side, the channel being open to the cavity and at least at the upper side and front end; (b) a light generating module having means for generating light and means for actuating the light generating means; (c) a holder having an annular portion and a pair of leg portions connected to the annular portion and extending therefrom in a spaced apart relationship such that the annular portion and leg portions respectively insert and fit within the cavity and channel of the main body structure and seat the actuating means and light generating means therein such that the light generating means directs a beam of light from the channel at the front end of the body structure; (d) a card covering at least the upper side of the main body structure and the light generating module and holder; and (e) an outer protective cover encasing the main body structure, light generating module, holder and card.

More particularly, the actuating means of the light generating module includes a battery, a dome-shaped switch member and an annular pad. The battery has first and second electrical contact portions of positive and negative polarities and is adapted to insert and fit within the annular portion of the holder. The dome-shaped switch member has outer and inner sides and is disposed over the first electrical contact portion of the battery and adapted to be deformed between an outer unflexed configuration and an inner flexed configuration. The annular pad of electrically insulative material is disposed between and engaged with the switch member and the first electrical contact portion of the battery and has a central hole such that the first electrical contact portion of the battery can be electrically contacted by the inner side of the switch member upon deforming the switch member from the outer unflexed configuration to the inner flexed configuration. The light generating means of the light generating module is a lamp has a bulb element and a pair of conductive lead elements extending, therefrom such that one of the lead elements is electrically connected to the outer side of the switch member and the other lead element is electrically connected to the second electrical contact portion of the battery. The annular portion of the holder seats the battery in the cavity of the body structure and the leg portions of the holder seat the bulb element of the lamp in the channel of the body structure.

In a first embodiment of the device, the main body structure includes lower and upper layers of rigid plastic material. The upper layer is formed upon the lower layer in the configuration of a longitudinal backbone portion and a plurality of rib portions extending in a transverse relation and opposite directions from the longitudinal backbone. The rib portions have curved upper edges that provide the upper layer of the body structure in an overall convex configuration extending laterally in opposite directions from the backbone portion. Further, in the first embodiment of the device, the card is a business card and the outer cover has a profile similar to that of the body structure so as to sandwich the business card between an upper face of the outer cover and the upper layer of the body structure such that the business card is contained in a correspondingly curved configuration on the upper layer of the body structure so as to overlie and cover the upper side of the body structure and said light generating module and holder disposed in said cavity and channel of said body structure. Still further, in the first embodiment of the device, the main body structure has a recess centrally located on said lower side thereof and a magnet is seated in said recess.

In a second embodiment of the device, the main body structure is a layer of foam material having a generally flat configuration and the card is a folded insert card covering said upper and lower sides of said body structure and said light generating module and holder disposed in said cavity and channel of said main body structure.

In both embodiments, the outer protective cover is transparent and has a generally flat sleeve-like configuration which surrounds, hermetically seals and encases said main body structure, light generating module, holder and card therein.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
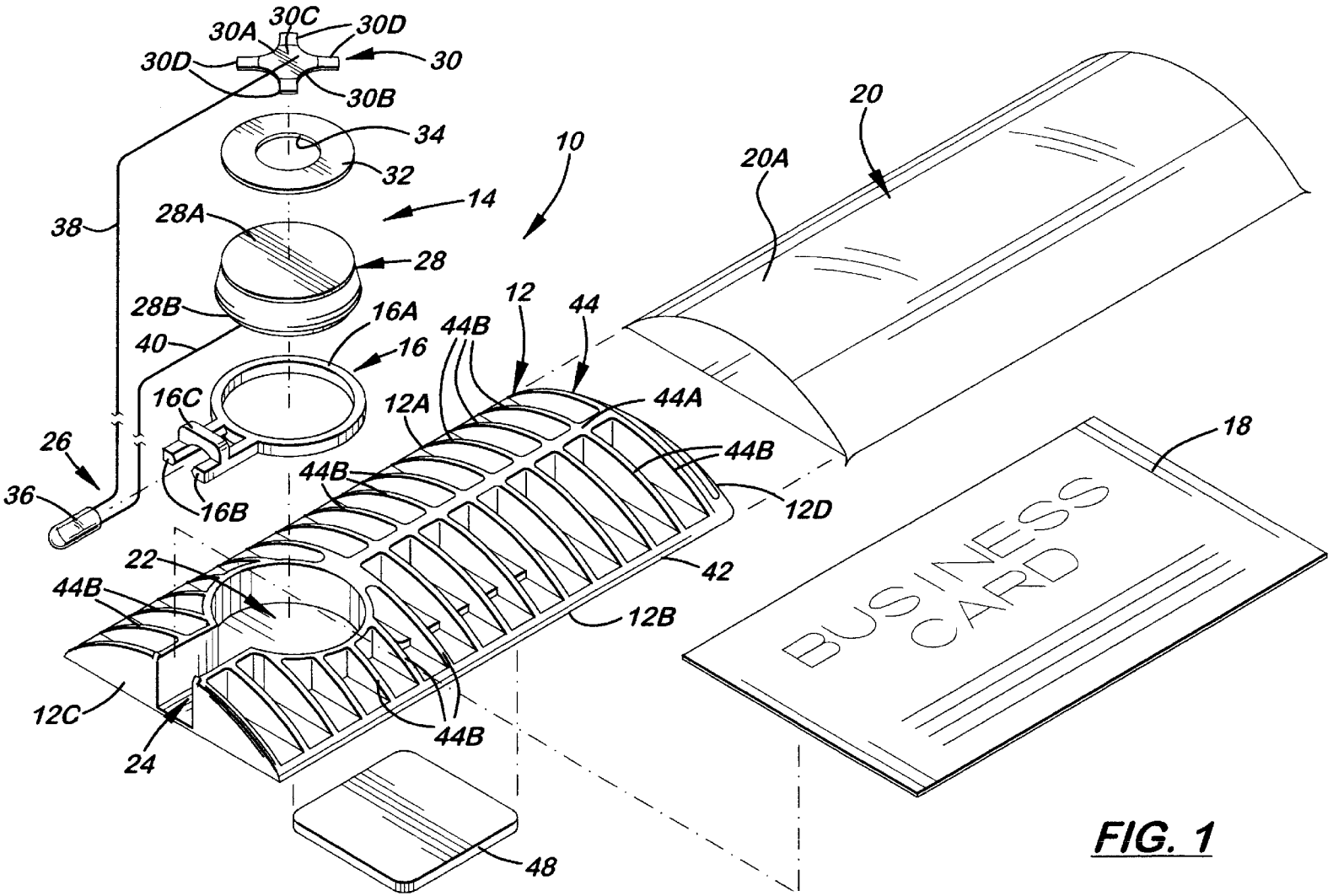
FIG. 1 is an exploded perspective view of a first embodiment of a card-like flashlight device of the present invention
Figure 2:
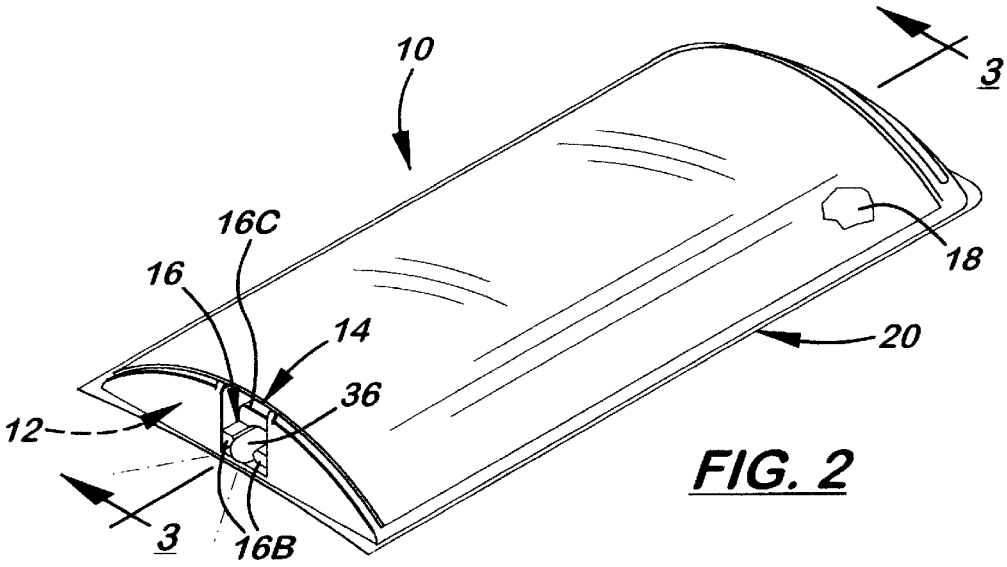
FIG. 2 is an assembled perspective view of the device of FIG. 1.
Figure 3:
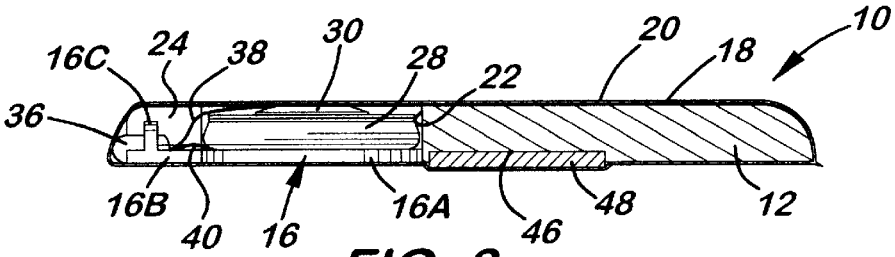
FIG. 3 is an enlarged longitudinal sectional view of the device taken along line 3—3 of FIG. 2.

Referring to the drawings and particularly to FIGS. 1 to 3 and FIGS. 6 to 8, there is illustrated, respectively, first and second embodiments of a card-like flashlight device of the present invention, generally designated 10. The flashlight device 10 basically includes a main body structure 12, a light generating module 14, a holder 16, a card 18 and an outer protective cover 20.

The main body structure 12 of the device 10 has upper and lower sides 12A, 12B, front and rear ends 12C, 12D. The body structure 12 also has a cavity 22 defined between the upper and lower sides 12A, 12B and located closer to the front end 12C than to the rear end 12D. The body structure 12 further has a channel 24 defined between the upper and lower sides 12A, 12B and extending between and interconnecting the cavity 22 and the front end 12C. The cavity 22 is open at least at the upper side 12A of the body structure 12. The channel 24 is open to the cavity 22 and at least at the upper side 12A and the front end 12C of the body structure 12.

Figure 4:
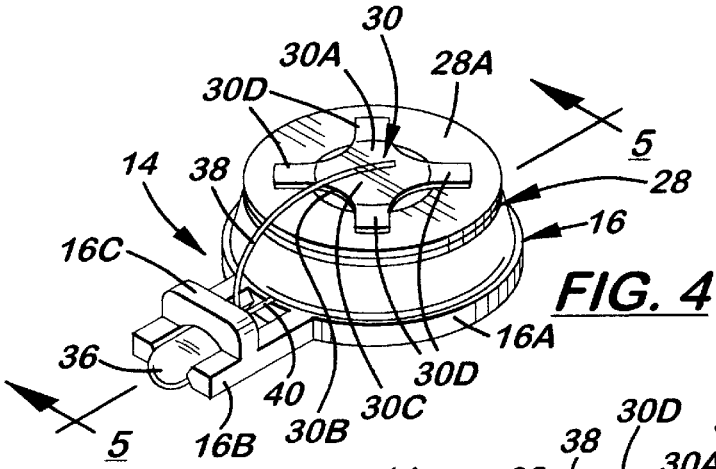
FIG. 4 is an enlarged assembled perspective view of the light generating module and holder of the device.
Figure 5:
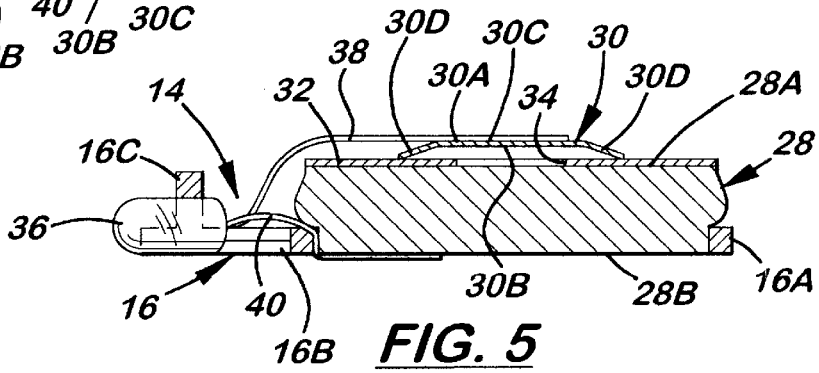
FIG. 5 is a longitudinal sectional view of the light generating module and holder taken along line 5—5 of FIG. 4.

The light generating module 14 and the holder 16 of the device 10 are also shown in FIGS. 4 and 5. The light generating module 14 has means for generating light in the form of a lamp 26, and means for actuating the light generating means or lamp 26 in the form of a battery 28, a dome-shaped switch member 30 and an annular pad 32. The battery 28 is preferably a button-cell type battery and has first and second electrical contact portions 28A, 28B of positive and negative polarities. The dome-shaped switch member 30 has outer and inner sides 30A, 30B, a center portion 30C and a plurality of leg portions 30D spaced apart from one another and extending radially outwardly form the center portion 30C. The center portion 30C is substantially circular in shape. Each leg portion 30D is partially rectangular in shape and substantially smaller than the center portion 30C. The leg portions 30C preferably are four in number. The switch member 30 is disposed over the first electrical contact portion 28A of the battery 28 and capable of being deformed at its center portion 30C between an outer convex unflexed configuration and an inner concave flexed configuration, as respectively seen in solid and dashed line forms in FIG. 5. Thus, in response to the application of a force, such as a predetermined finger pressure, to the outer side 30A thereof, the center portion 30C of the switch member 30 is deformed from the outer unflexed configuration to the inner flexed configuration and in response to release of the force therefrom returns to the outer unflexed configuration. The annular pad 32 is made of electrically insulative material and disposed between and engaged with the switch member 30 and the first electrical contact portion 28A of the battery 28. The annular pad 32 electrically insulates the switch member 30 from the battery 28 when the switch member 30 is at its unflexed outer position. The annular pad 32 has a central hole 34 such that the first electrical contact portion 28A of the battery 28 can be electrically contacted by the inner side 30B of the switch member 30 upon flexing of the switch member 30 from the outer position, as seen in solid form in FIG. 5, to the inner position, as seen in dashed line form in FIG. 5. The lamp 26 has a bulb element 36 and a pair of conductive lead elements 38, 40 extending therefrom and from the channel 24 into the cavity 22. One of the lead elements 38 is electrically and fixedly connected to the outer side 30A of the switch member 30 and the other lead element 40 is electrically and fixedly connected to the second electrical contact portion 28B of the battery 28.

The holder 16 of the device 10 has an annular portion. 16A, a pair of leg portions 16B connected to the annular portion 16A and extending therefrom in a generally parallel spaced apart relationship with one another, and an arch portion 16C extending above and between and interconnecting the leg portions 16B. The annular portion 16A of the holder 16 snugly inserts and fits within the cavity 22 of the body structure 12. The leg portions 16B and arch portion 16C of the holder 16 snugly insert and fit within the channel 24 of the body structure 12. The battery 28 preferably is circular in shape adapting it to snugly insert and fit within the annular portion 16A of the holder 16. Thus, the annular portion 16A of the holder 16 seats the battery 28 in the cavity 22 of the body structure 12. The bulb element 36 of the lamp 26 seats in the channel 24 of the body structure 12 between the leg portions 16B and below the arch portion 16C of the holder 16 such that the bulb element 36 directs a beam of light from the channel 24 at the front end 12C of the main body structure 12.

The card 18 of the device 10 covers at least the upper side 12A of the main body structure 12 and the light generating module 14 and the holder 16. The outer protective cover 20 of the device 10, being made of a suitable flexible plastic material, encases the main body structure 12, the light generating module 14, the holder 16 and the card 18. More particularly, the outer protective cover 20 is preferably transparent and peripherally sealed and has a generally flat sleeve-like configuration which surrounds, hermetically seals and encases the main body structure 12, the light generating module 14, the holder 16 and the card 18 therein.

Referring to FIGS. 1 to 5, in the first embodiment of the device 10, the main body structure 12 further has lower and upper layers 42, 44 of rigid plastic material. The upper layer 44 is formed upon the lower layer 42 in the configuration of a longitudinal backbone portion 44A and a plurality of rib portions 44B extending in a transverse relation and opposite directions from the longitudinal backbone portion 44A. The rib portions 44B have curved upper edges that provide the upper layer 44 of the body structure 12 in an overall convex configuration extending laterally in opposite directions from the backbone portion 44A. Further, in the first embodiment of the device 10, the card 18 is a business card 18 and the outer cover 20 has a profile similar to that of the body structure 12 so as to sandwich the business card 18 between an upper face 20A of the outer cover 20 and the upper layer 44 of the body structure 12 such that the business card 18 is contained in a correspondingly curved configuration on the upper layer 44 of the body structure 12 so as to overlie and cover the upper side 12A of the body structure 12 and the light generating module 14 and holder 16 disposed in the cavity 22 and the channel 24 of the body structure 12. As is well-known, the business card 18 has business information thereon that can be seen through the upper face 20A of the transparent outer cover 20. Still further, in the first embodiment of the device 10, the main body structure 12 has a recess 46 centrally located on the lower side 12B thereof and a magnet 48 is seated and retained in the recess 46.

Figure 6:
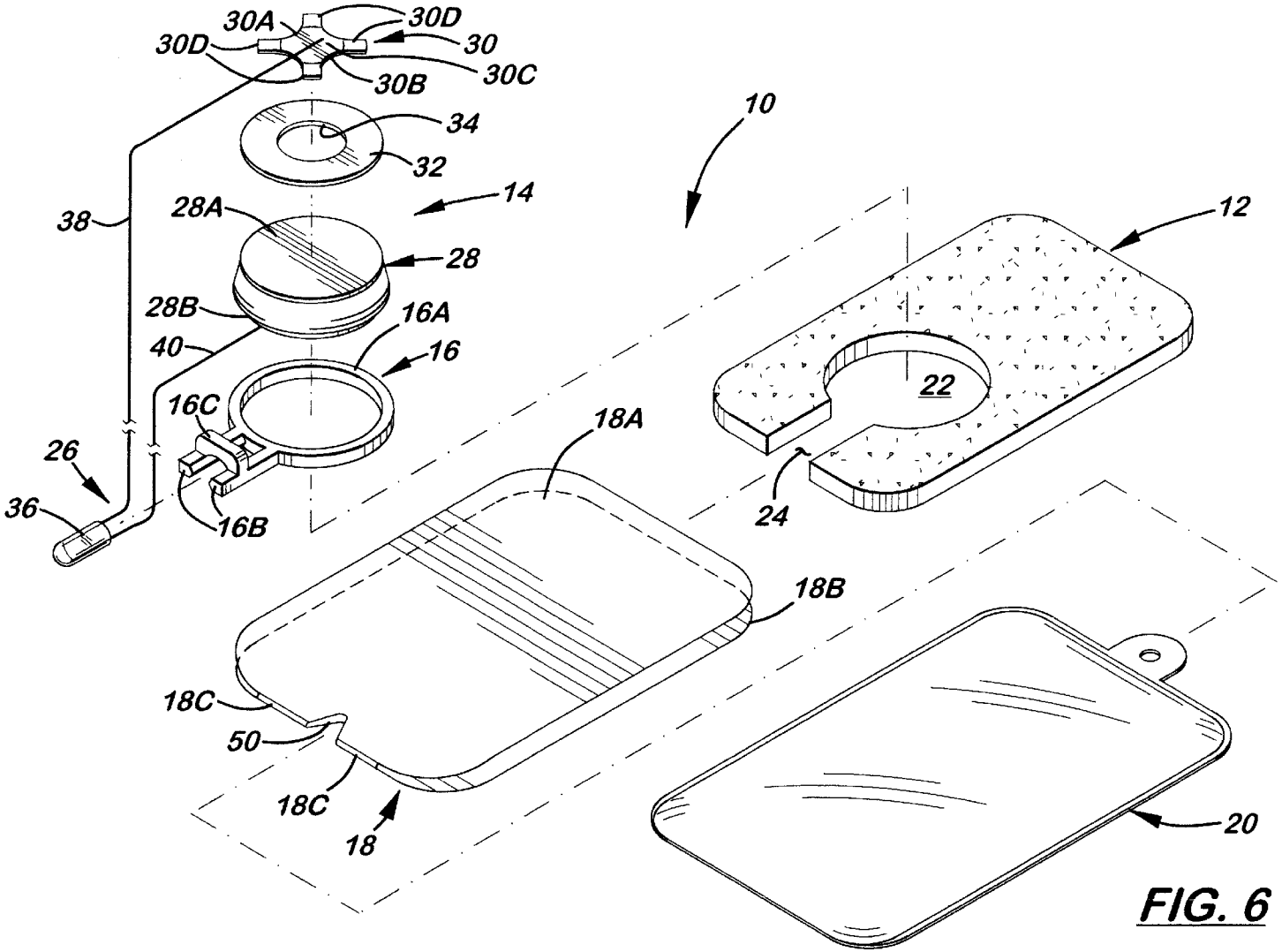
FIG. 6 is an exploded perspective view of a second embodiment of the card-like flashlight device of the present invention.
Figure 7:
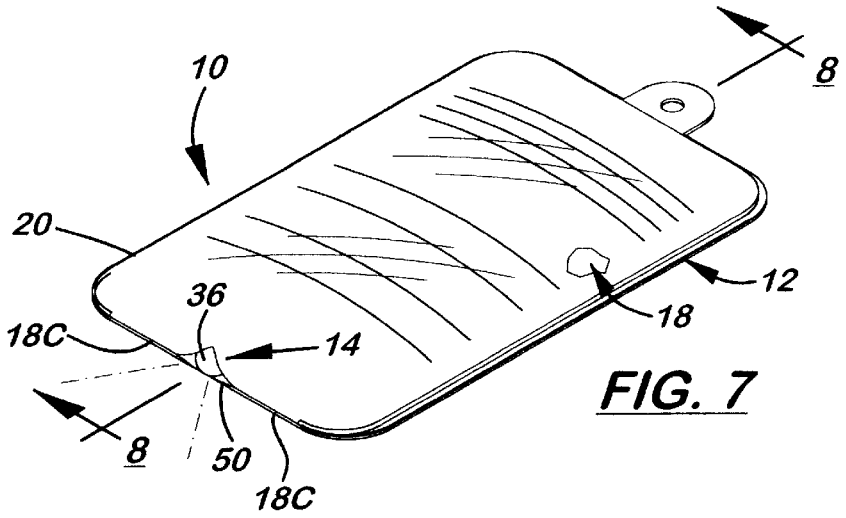
FIG. 7 is an assembled perspective view of the device of FIG. 6.
Figure 8:
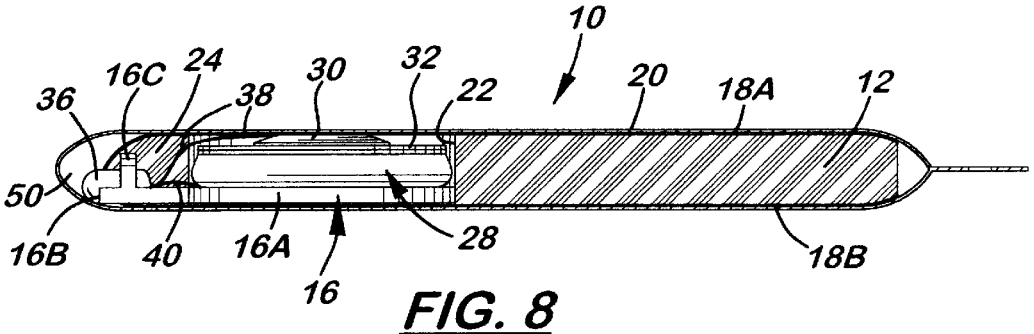
FIG. 8 is an enlarged longitudinal sectional view of the device taken along line 8—8 of FIG. 7.
Figure 9:
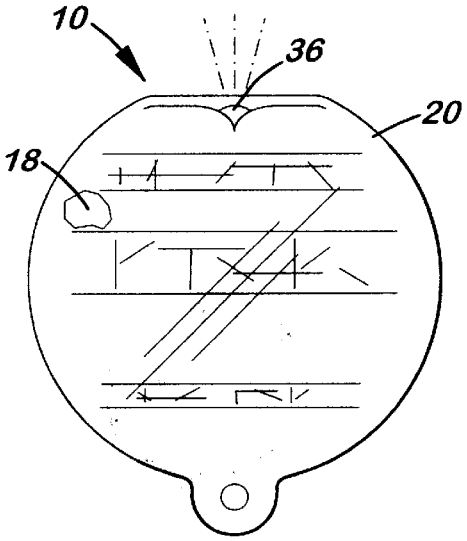
FIG. 9 is a plan view of the device of FIG. 7 which is the same except for having a generally circular exterior shape.
Figure 10:
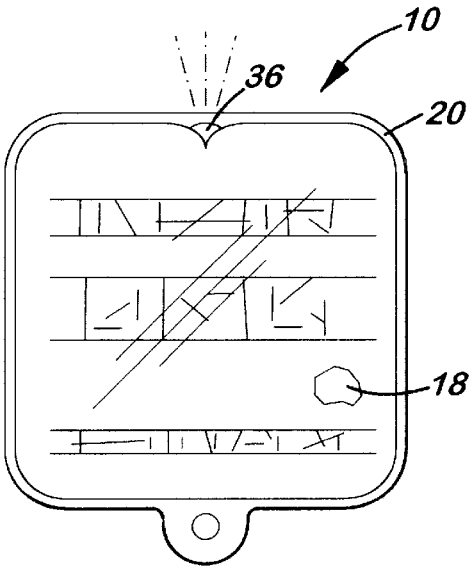
FIG. 10 is a plan view of the device of FIG. 7 which also is the same except for having a generally square exterior shape.

Referring to FIGS. 6 to 10, in the second embodiment of the device 10, the main body structure 12 is a layer of foam material having a generally flat configuration and uniform thickness, and the card 18 is a folded insert card 18 having portions 18A, 18B covering respectively the upper and lower sides 12A, 12B of the body structure 12 and the light generating module 14 and holder 16 disposed in the cavity 22 and channel 24 of the body structure 12. The folded insert card 18 has an opening 50 formed therein along the middle fold line 18C so as to define an aperture aligned with the bulb element 36 of the lamp 26 of the light generating module 14. Both portions 18A, 18B of the folded insert card 18 may be imprinted with a media that displays information to a user of the device 10, such as logos and other information printed thereon, which can be seen through the transparent outer cover 20. The body structure 12, card 18 and outer cover 20 together can provide the device 10 with different exterior shapes. More particularly, these components together provide the device 10 in one of a rectangular shape as seen in FIG. 6, a circular shape as seen in FIG. 9 or a square shape as seen in FIG. 10.

It is thought that the present invention and many of its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A flashlight device, comprising:

(a) a main body structure having upper and lower sides, front and rear ends, a cavity defined between said upper and lower sides and located closer to said front end than to said rear end, and a channel defined between said upper and lower sides and extending between and interconnecting said cavity and said front end, said cavity being open at least at said upper side, said channel being open to said cavity and at least at said upper side and said front end;

(b) a light generating module having means for generating light and means for actuating said light generating means;

(c) a holder having an annular portion and a pair of leg portions connected to said annular portion and extending therefrom in a spaced apart relationship such that said annular portion and leg portions respectively insert and fit within said cavity and said channel of said main body structure and seat said actuating means and light generating means thereon such that said light generating means directs a beam of light from said channel at said front end of said body structure;

(d) a card covering at least said upper side of said main body structure and said light generating module and holder; and (e) an outer protective cover encasing said main body structure, light generating module, holder and card.

2. The device of claim 1 wherein said actuating means of said light generating module includes a battery having first and second electrical contact portions of positive and negative polarities and being configured to insert and fit within said annular portion of said holder.

3. The device of claim 2 wherein said actuating means of said light generating module also includes a dome-shaped switch member having outer and inner sides and being disposed over said first electrical contact portion of said battery and adapted to be deformed between an outer unflexed configuration and an inner flexed configuration.

4. The device of claim 3 wherein said actuating means of said light generating module further includes an annular pad of electrically insulative material disposed between and engaged with said switch member and said first electrical contact portion of said battery and having a central hole such that said first electrical contact portion of said battery can be electrically contacted by said inner side of said switch member upon deforming of said switch member from said outer unflexed configuration to said inner flexed configuration.

5. The device of claim 3 wherein said light generating means of said light generating module is a lamp having a bulb element and a pair of conductive lead elements extending therefrom such that one of said lead elements is electrically connected to said outer side of said switch member and the other of said lead elements is electrically connected to said second electrical contact portion of said battery.

6. The device of claim 5 wherein said annular portion of said holder seats said battery in said cavity of said body structure and said leg portions of said holder seat said bulb element of said lamp in said channel of said body structure.

7. The device of claim 6 wherein said holder also has an arch portion extending above, between and interconnecting said leg portions such that the bulb element of said lamp is disposed below said arch portion.

8. The device of claim 1 wherein said main body structure includes lower and upper layers of rigid plastic material, said upper layer being formed upon said lower layer in the configuration of a longitudinal backbone portion and a plurality of rib portions extending in a transverse relation and opposite directions from said longitudinal backbone.

9. The device of claim 8 wherein said card is a business card supported on said upper layer of said main body structure so as to overlie and substantially cover said upper side thereof and said light generating module and holder disposed in said cavity and channel of said body structure.

10. The device of claim 1 wherein said main body structure is a layer of foam material having a generally flat configuration.

11. The device of claim 10 wherein said card is a folded insert card covering said upper and lower sides of said main body structure and said light generating module and holder disposed in said cavity and channel of said body structure.

12. The device of claim 11 wherein said insert card having a fold line and a hole therein aligned with said light generating module and said channel of said body structure.

13. The device of claim 1 wherein said card is a business card covering said upper side of said main body structure and said light generating module and holder disposed in said cavity and channel of said body structure.

14. The device of claim 1 wherein said card is a folded insert card covering said upper and lower sides of said main body structure and said light generating module and holder disposed in said cavity and channel of said body structure.

15. The device of claim 14 wherein said insert card having a fold line and a hole therein aligned with said light generating module and said channel of said body structure.

16. The device of claim 1 wherein said outer protective cover is substantially transparent and has a generally flat sleeve-like configuration which surrounds, hermetically seals and encases said main body structure, light generating module, holder and card therein.

17. The device of claim 1 wherein said main body structure, said outer protective cover and said card together are provided in one of a rectangular, circular or square shape.

18. The device of claim 1 wherein said main body structure has a recess centrally located on said lower side thereof and a magnet seated in said recess and disposed within said outer protective cover.

19. A flashlight device, comprising:

(a) a main body structure having upper and lower sides, front and rear ends, a cavity defined between said upper and lower sides and located closer to said front end than to said rear end, and a channel defined between said upper and lower sides and extending between and interconnecting said cavity and said front end, said cavity being open at least at said upper side, said channel being open to said cavity and being open at least at said upper side and said front end;

(b) a light generating module including a battery having first and second electrical contact portions of positive and negative polarities, a dome-shaped switch member having outer and inner sides and being disposed over said first electrical contact portion of said battery and adapted to be deformed between an outer unflexed configuration and an inner flexed configuration, an annular pad of electrically insulative material disposed between and engaged with said switch member and said first electrical contact portion of said battery and having a central hole such that the first electrical contact portion of said battery can be electrically contacted by said inner side of said switch member upon deforming of said switch member from said outer unflexed configuration to said inner flexed configuration, and a lamp having a bulb element and a pair of conductive lead elements extending therefrom such that one of said lead elements is electrically connected to said outer side of said switch member and the other of said lead elements is electrically connected to said second electrical contact portion of said battery;

(c) a holder having an annular portion and a pair of leg portions connected to said annular portion and extending therefrom in a generally spaced apart relationship to one another such that said annular portion is adapted to insert and fit within said cavity of said main body structure and said leg portions are adapted to insert and fit within said channel of said main body portion, said annular portion seating said battery of said light generating module in said cavity of said body structure and said leg portions seating said bulb element of said lamp of said light generating element in said channel of said body structure such that said light generating element directs a beam of light from said channel at said front end of said body structure;

(d) a card covering at least one of said opposite sides of said main body structure and said light generating module and holder disposed in said cavity and channel of said main body structure; and (e) an outer transparent protective cover in a generally flat sleeve-like configuration surrounding and hermetically sealing and encasing said main body structure, light generating module, holder and card therein.

20. The device of claim 19 wherein said holder also has an arch portion extending above, between and interconnecting said leg portions such that the bulb element of said lamp is disposed below said arch portion.

21. The device of claim 19 wherein said main body structure includes lower and upper layers of rigid plastic material, said upper layer being formed upon said lower layer in the configuration of a longitudinal backbone portion and a plurality of rib portions extending in a transverse relation and opposite directions from said longitudinal backbone.

22. The device of claim 21 wherein said card is a business card supported on said upper layer of said main body structure so as to overlie and substantially cover said upper side thereof and said light generating module and holder disposed in said cavity and channel of said body structure.

23. The device of claim 19 wherein Said main body structure is a layer of foam material having a generally flat configuration.

24. The device of claim 23 wherein said card is a folded insert card covering said upper and lower sides of said main body structure and said light generating module and holder disposed in said cavity and channel of said body structure.

25. The device of claim 24 wherein said insert card having a fold line and a hole therein aligned with said light generating module and said channel of said body structure.

26. The device of claim 19 wherein said card is a business card covering said upper side of said main body structure and said light generating module and holder disposed in said cavity and channel of said body structure.

27. The device of claim 19 wherein said card is a folded insert card covering said upper and lower sides of said main body structure and said light generating module and holder disposed in said cavity and channel of said body structure.

28. The device of claim 19 wherein said outer protective cover is substantially transparent and has a generally flat sleeve-like configuration which surrounds, hermetically seals and encases said main body structure, light generating module, holder and card therein.

29. The device of claim 19 wherein said main body structure, said outer protective cover and said card together are provided in one of a rectangular, circular or square shape.

30. The device of claim 19 wherein said main body structure has a recess centrally located on said lower side thereof and a magnet seated in said recess and disposed within said outer protective cover.

* * * * *